US011208773B2

(12) United States Patent
Mueller et al.

(10) Patent No.: US 11,208,773 B2
(45) Date of Patent: Dec. 28, 2021

(54) SAFELY CONE ENHANCER

(71) Applicants: Keegan Mcclure Mueller, Shady Spring, WV (US); Craig Page Mueller, Shady Spring, WV (US)

(72) Inventors: Keegan Mcclure Mueller, Shady Spring, WV (US); Craig Page Mueller, Shady Spring, WV (US)

( * ) Notice: Subject to any disclaimer, the term of this patent is extended or adjusted under 35 U.S.C. 154(b) by 543 days.

(21) Appl. No.: 16/216,495

(22) Filed: Dec. 11, 2018

(65) Prior Publication Data

US 2019/0177934 A1 Jun. 13, 2019

Related U.S. Application Data

(60) Provisional application No. 62/597,248, filed on Dec. 11, 2017.

(51) Int. Cl.

| | |
|---|---|
| ***E01F 9/654*** | (2016.01) |
| ***G09F 17/00*** | (2006.01) |
| ***E01F 9/688*** | (2016.01) |
| ***E01F 13/02*** | (2006.01) |
| ***E01F 9/615*** | (2016.01) |

(52) U.S. Cl.

CPC ..... *E01F 9/654* (2016.02); *E01F 9/617* (2016.02); *E01F 9/688* (2016.02); *E01F 13/028* (2013.01); *G09F 17/00* (2013.01); *G09F 2017/0066* (2013.01)

(58) Field of Classification Search

CPC ..... E01F 9/654; E01F 13/028; E01F 9/617; E01F 9/688; G09F 17/00; G09F 2017/0066

See application file for complete search history.

(56) References Cited

U.S. PATENT DOCUMENTS

| | | | | | |
|---|---|---|---|---|---|
| 2,191,075 | A * | 2/1940 | Hogan | ..... | E04H 12/32 248/541 |
| 3,732,842 | A * | 5/1973 | Vara, Sr. | ..... | E01F 9/654 116/63 P |
| 5,269,251 | A * | 12/1993 | Freeman | ..... | E01F 13/02 116/63 C |

(Continued)

FOREIGN PATENT DOCUMENTS

| | | | | |
|---|---|---|---|---|
| DE | 19820022 A1 | 12/1999 | | |
| FR | 2997971 A1 | 5/2016 | | |
| WO | WO-9933526 A1 * | 7/1999 | ..... | A63B 1/00 |

*Primary Examiner* — Nimeshkumar D Patel
*Assistant Examiner* — Tania Courson
(74) *Attorney, Agent, or Firm* — Kramer Amado

(57) ABSTRACT

A safety cone enhancer fits onto a traffic cone or safety cone. The traffic cone or safety cone has a conical member with a first diameter at a base of the conical member and a second diameter at a top of the conical member. The safety cone enhancer has a round or polygonal member with a hole therethrough, the hole having a diameter which is less than the first diameter of the traffic cone and greater than the second diameter of the traffic cone. The safety cone enhancer has a plurality of arms extending from the round or polygonal member; and at least one of:

a first hole in said round or polygonal member extending through said polygonal member from the top surface to the bottom surface, said first hole being configured to receive a first signaling device; and a second signaling device which shines light from a surface of the round or polygonal member.

16 Claims, 8 Drawing Sheets

(56) References Cited

U.S. PATENT DOCUMENTS

| | | | | |
|---|---|---|---|---|
| 5,467,548 | A * | 11/1995 | Ross | E01F 13/022 116/63 C |
| 6,527,245 | B2 * | 3/2003 | Graves | E01F 9/615 102/343 |
| 8,544,407 | B2 * | 10/2013 | Spray | E01F 9/688 116/63 C |
| 8,602,584 | B2 * | 12/2013 | Ghafoori | E01F 9/688 362/157 |
| 8,777,512 | B2 * | 7/2014 | Henderson | E01F 13/02 404/9 |
| 9,347,189 | B2 * | 5/2016 | Eccless | E01F 9/688 |
| 10,494,780 | B2 * | 12/2019 | Koyle | E01F 9/654 |
| 2006/0032426 | A1 * | 2/2006 | Kuo | E01F 13/02 116/63 P |
| 2012/0186511 | A1 | 7/2012 | Spray | |
| 2013/0333610 | A1 | 12/2013 | Egoless et al. | |
| 2016/0230357 | A1 | 8/2016 | Dia | |

* cited by examiner

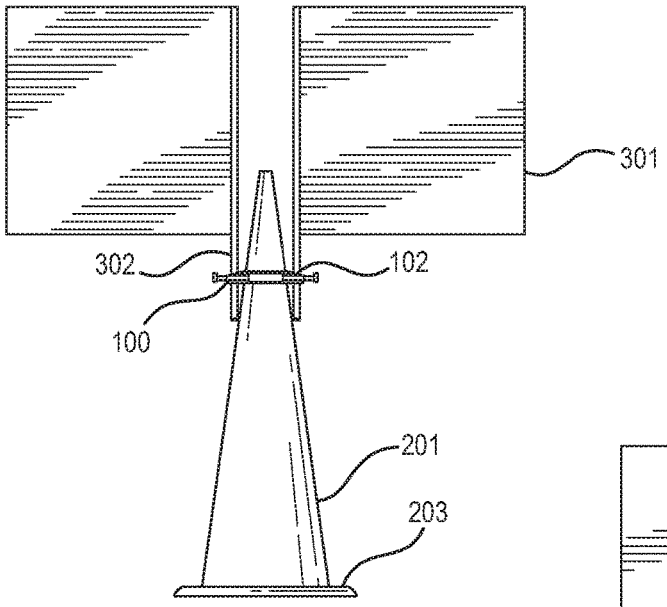
FIG. 3A
FIG. 3B
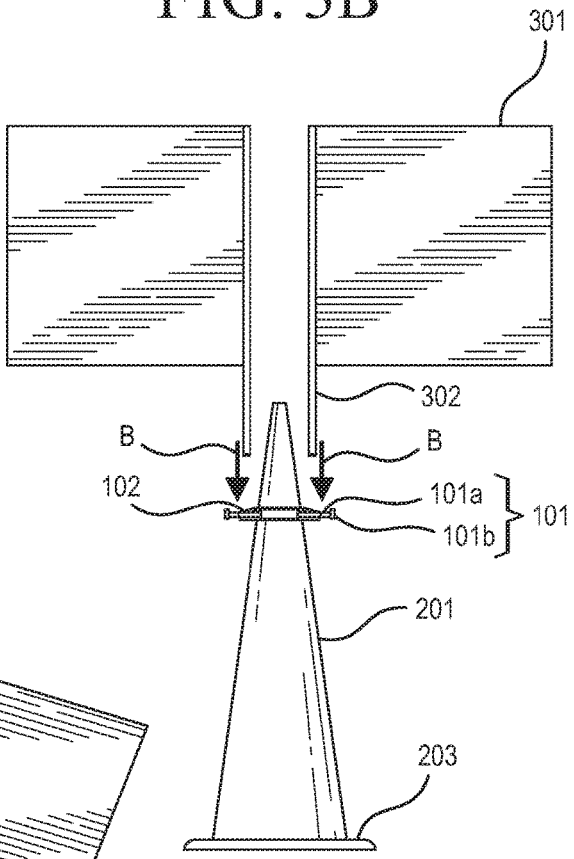
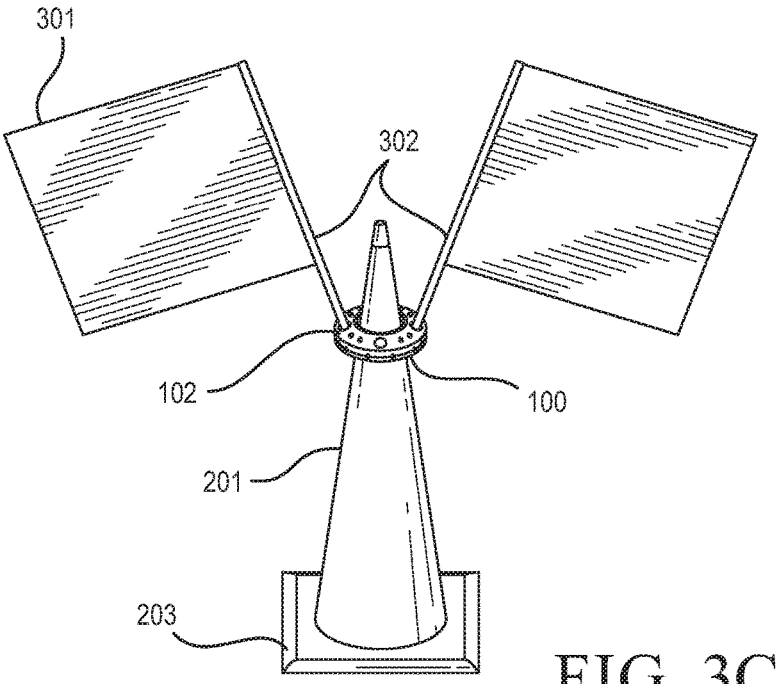
FIG. 3C

SAFELY CONE ENHANCER

CROSS REFERENCE TO RELATED APPLICATIONS

This application claims priority to provisional U.S. Application No. 62/597,248, filed on Dec. 11, 2017. The entire disclosure of the prior application is hereby incorporated by reference herein in its entirety.

TECHNICAL FIELD

Various embodiments disclosed herein relate generally to a safety cone enhancer and, more particularly but not exclusively, to a safety cone enhancer which includes safety features and links multiple safety cones together.

BACKGROUND

Safety cones are used for road and pathway safety to mark spaces on roads to avoid, mark caution and otherwise inform cars and pedestrians on roadways and pathways of potential hazards.

These safety cones are customarily composed of a distinct color (e.g., orange) to ensure that cars and pedestrians can see the safety cones in all conditions. They are also traditionally shaped in a stackable triangular shape and are produced in a variety of different sizes.

Safety cones are often placed in rows to alert drivers and pedestrians that the hazard extends as far as the safety cones extend and to avoid the area.

Safety cones are traditionally connected to each other by tape or other rope to alert cars and pedestrians not to cross into the marked roadway or area. Specifically, safety cones are attached to each other by using safety tape which is often tied around the top of the safety cone in a knot then extended to the next safety cone.

Given the importance of safety cones on roadways and pathways it is necessary to develop safety cones which can be easily linked to each other and which include safety features.

SUMMARY

Various embodiments disclosed herein relate to a safety cone enhancer, which is an apparatus for use with a traffic cone. The traffic cone has a conical member with a first diameter at a base of the conical member and a second diameter at a top of the conical member; and a generally planar support to which the base of the conical member is attached. The safety cone enhancer comprises a ring-shaped member with a top surface, a bottom surface, an outer diameter, and central hole with an inner diameter. The ring-shaped member of the safety cone enhancer may have planar top and bottom surfaces. Alternatively, one or both of the top and bottom surfaces may be nonplanar, so that the ring-shaped member is thicker at the inner diameter than at the outer diameter. One or both of the top and bottom surfaces may be nonplanar beveled surfaces with a constant slope, or curved surfaces with a variable slope.

The inner diameter is less than the first diameter of the conical member of the traffic cone, and greater than the second diameter of the conical member. The central hole of the ring-shaped member may be placed on the conical member of the traffic cone, so that the ring-shaped member is positioned between the base and the top of the conical member.

In various embodiments, the safety cone enhancer has a plurality of arms, where each arm has a connector extending from the ring-shaped member and a head which is wider than the connector in at least one direction. The safety cone enhancer additionally has at least one hole in the ring-shaped member, which is configured to receive a signaling device.

In various embodiments, the safety cone enhancer has a first hole in the ring-shaped member extending through said ring-shaped member from the top surface to the bottom surface, where the first hole is configured to receive a first signaling device. The first signaling device may be a safety flag or an LED signal device.

In various embodiments, the safety cone enhancer has a second hole in said ring-shaped member extending radially into said ring-shaped member, where the second hole is configured to receive an LED signal device.

In various embodiments, the safety cone enhancer has: a first hole in the ring-shaped member extending through said ring-shaped member from the top surface to the bottom surface, where the first hole is configured to receive a safety flag; and at least one of: a second hole in said ring-shaped member extending radially into said ring-shaped member, configured to receive a light-emitting signal device; and a third hole in the ring-shaped member extending through said ring-shaped member from the top surface to the bottom surface, configured to receive a light-emitting signal device.

In various embodiments, the safety cone enhancer has a plurality of arms, where each arm has a connector extending radially from the ring-shaped member, and a head which is wider than the connector in at least one dimension. The head may be elongated, and wider than the connector in a direction which is perpendicular to an axis of said ring-shaped member, or in a direction which is parallel to an axis of said ring-shaped member. The head may be elongated, and wider than the connector in a direction which is at an angle relative to the axis of the ring-shaped member, where the angle is between 0° and 90°; between 10° and 80°; between 20° and 70°; between 30° and 60°; between 40° and 50°; or about 45°.

In various embodiments, the safety cone enhancer has a plurality of arms, where each arm has a connector having a first circumference extending radially from the ring-shaped member, and a head having a second circumference which is greater than the first circumference.

In various embodiments, the safety cone enhancer has a plurality of arms, where each arm has a connector extending vertically from the ring-shaped member, and a head positioned in a groove in a top surface of said ring-shaped member.

Various embodiments disclosed herein relate to an apparatus for use with a traffic cone having a conical member with a first diameter at a base of the conical member and a second diameter at a top of the conical member, comprising a polygonal member with a top surface, a bottom surface, a plurality of edges, and a hole with a third diameter therethrough. The third diameter is less than the first diameter of the traffic cone, and greater than the second diameter of the traffic cone. The polygonal member has a plurality of arms, each arm having a connector extending from the polygonal member and a head which is wider than the connector in at least one direction. Each arm may extend from an edge of the polygonal member, or a vertex of the polygonal member. The polygonal member is preferably in the shape of a regular polygon. The regular polygon may have an even or odd number of sides. The regular polygon may be, but is not limited to, a triangle, square, pentagon, hexagon, or octagon. A first hole in the polygonal member extends through said polygonal member from the top surface to the bottom surface, said first hole being configured to receive a first signaling device; and optionally has a second hole in the polygonal member extending into one of said edges of said polygonal member, the second hole being configured to receive a second signaling device.

Various embodiments disclosed herein relate to a kit, comprising a plurality of safety cone enhancers for use with a traffic cone as described herein; a signaling device configured to be positioned in a hole in the ring-shaped member of the safety cone enhancer; and safety tape which may be tied around an arm of the safety cone enhancer, or wrapped around the connector of an arm of the safety cone enhancer, as needed.

BRIEF DESCRIPTION OF THE DRAWINGS

In order to better understand various embodiments, reference is made to the accompanying drawings, wherein:

FIG. 3A illustrates a side view of the safety cone enhancer of FIG. 1A, positioned on a safety cone with safety flags positioned in the safety cone enhancer, so that the flagpoles are vertical;

FIG. 3B illustrates a side view of the safety cone enhancer of FIG. 1A, positioned on a safety cone with safety flags being inserted into the safety cone enhancer;

FIG. 3C illustrates a side view of the safety cone enhancer of FIG. 1C, positioned on a safety cone with safety flags positioned in the safety cone enhancer, so that the flagpoles are angled relative to an axis of the safety conef;

To facilitate understanding, identical reference numerals have been used to designate elements having substantially the same or similar structure or substantially the same or similar function.

DETAILED DESCRIPTION

The description and drawings presented herein illustrate various principles. It will be appreciated that those skilled in the art will be able to devise various arrangements that, although not explicitly described or shown herein, embody these principles and are included within the scope of this disclosure. As used herein, the term, "or" refers to a non-exclusive or (i.e., and/or), unless otherwise indicated (e.g., "or else" or "or in the alternative"). Additionally, the various embodiments described herein are not necessarily mutually exclusive and may be combined to produce additional embodiments that incorporate the principles described herein.

Traditional safety cones include a generally planar base and a conical member with an axis, where the axis of the conical member is perpendicular to the plane of the base. The conical member may be hollow, with an outer surface defining a right cylindrical cone. The conical member may be hollow, with a base having a first diameter D1 and an apex with a second diameter D2, where the second diameter D2 is less than the first diameter D1. The planar base typically has a hole therethrough, allowing the safety cones to be stacked so that the conical member of an upper cone may fit over the conical member of a lower cone. Traditional safety cones include many deficiencies, as they lack a structure which allows two cones to be safely and easily connected to each other. Additionally, safety cones do not allow the user to attach safety flags, signal lights, or other necessary safety features to the safety cones.

Figure 1A:
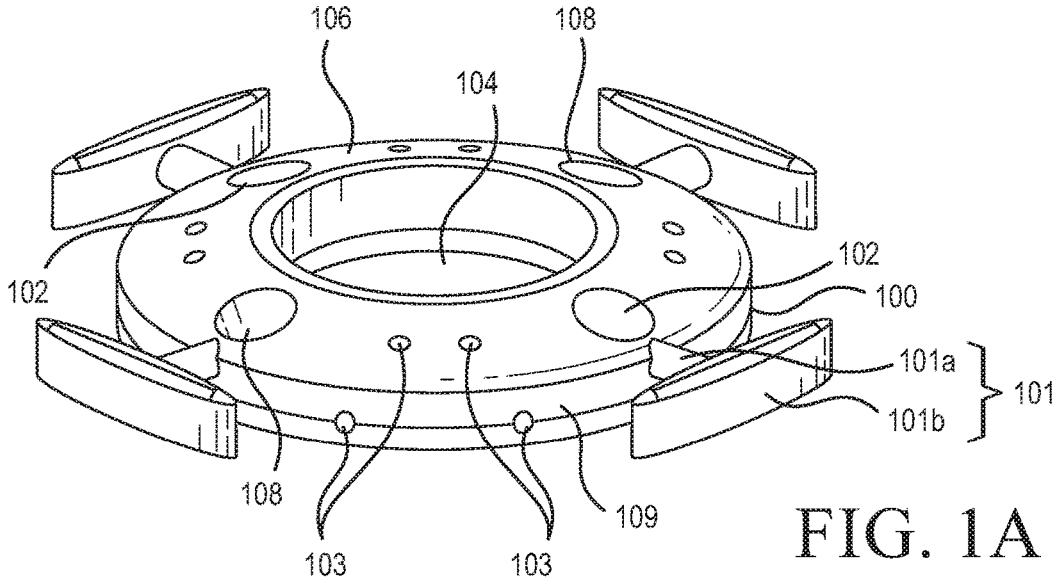
FIG. 1A illustrates a perspective view of the safety cone enhancer in a first embodiment.

FIG. 1A shows a perspective view of a first embodiment of a safety cone enhancer 100 as disclosed herein. The safety cone enhancer 100 may be circular in shape with a circular hole 104 in the center of the safety cone enhancer 100, as shown in FIG. 1A. The circular hole 104 may extend through the center of the safety cone enhancer 100 from a top surface to a bottom surface, and may have a diameter large enough to fit on top of a triangular safety cone and to rest on the top portion of the safety cone, without falling to the base of the safety cone. The circular hole 104 in the safety cone enhancer 100 may have a diameter D3 which is less than the first diameter D1 of the base of the conical member of the safety cone; and greater than the second diameter D2 of the apex of the conical member of the safety cone, i.e., D1>D3>D2.

The safety cone enhancer 100 may be fitted to a traditional safety cone by fitting the apex of the conical member of the safety cone through the hole 104 in the safety cone enhancer 100, and allowing the safety cone enhancer 100 to slide down the conical member of the safety cone until the inner edge of hole 104 contacts the outer surface of the conical member. The safety cone enhancer 100 will then rest by gravity between the base of the conical member, and the apex of the conical member. The relative position of safety cone enhancer 100 between the base and the apex of the conical member may be changed by adjusting the diameter of hole 104. Assuming that the conical member of the safety cone is a right cylinder, if hole 104 in safety cone enhancer 100 has a diameter D3 which is 50% of the first diameter D1 of the base of the conical member, the safety cone enhancer 100 will rest halfway between the base and the apex of the conical member. If hole 104 has a diameter D3 which is 25% of the first diameter D1, the safety cone enhancer 100 will rest below the apex of the conical member, about 75% of the height of the conical member from the base.

The safety cone enhancer 100 may rotate around the vertical axis of the safety cone to change the position of the safety cone enhancer 100.

In the embodiment of FIG. 1A, the safety cone enhancer 100 may include a plurality of arms 101 around the outer edge of the safety cone enhancer 100. In the embodiment of FIG. 1, the arms 101 are positioned to extend radially outward from a generally circular safety cone enhancer 100. The arms 101 have a connector 101*a* that extends from the side of the safety cone enhancer 100, and a head 101*b* connected to the connector 101*a*. The head may be wider than the connector in in at least one dimension, in order to facilitate securing safety tape between adjacent cones. As seen in FIG. 1A, the head 101*b* of arm 101 may be oblong. As seen in FIG. 1A, the connector 101*a* may have a first width. The head 101*b* may be elongated, with a second width which is wider than the first width of the connector in a direction which is perpendicular to an axis of said ring-shaped member, or parallel to a plane of the ring-shaped member. Alternatively, head 101*b* may be elongated, with a second width which is wider than the first width of the connector in a direction which is parallel to an axis of the ring-shaped member. The head 101*b* may be elongated, and wider than the connector 101*a* in a direction which is at an angle relative to the axis of the ring-shaped member, where the angle is between 0° and 90°; between 10° and 80°; between 20° and 70°; between 30° and 60°; between 40° and 50°; or about 45°.

In the embodiment of FIG. 1A, the safety cone enhancer is circular, with arms 101 which may be equally spaced apart from each other around the outer edge of the safety cone enhancer 100, and extend radially from the outer edge of enhancer 100.

Figure 1B:
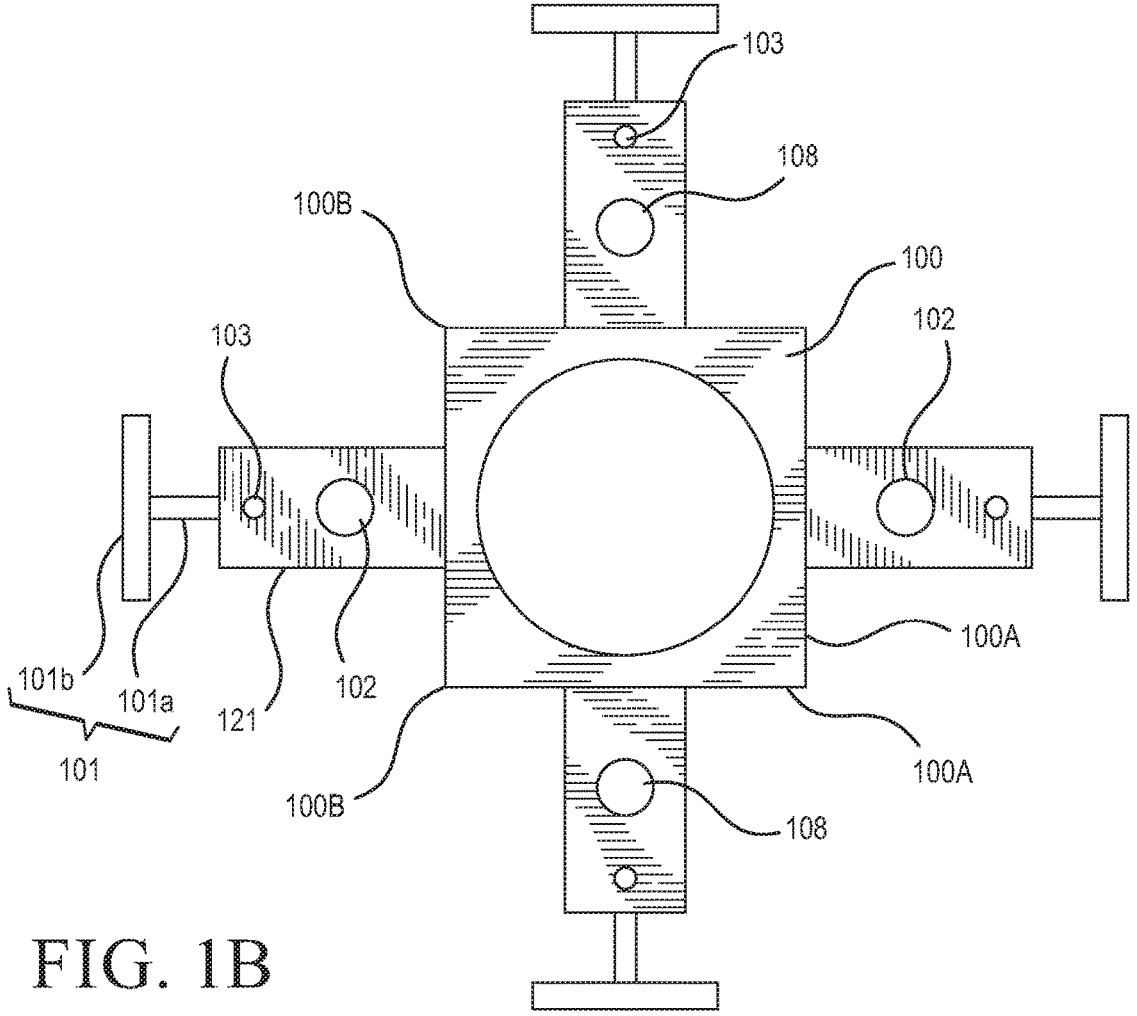
FIG. 1B illustrates a view of the safety cone enhancer in a second embodiment.

In various embodiments illustrated in FIG. 1B, the safety cone enhancer 100 is shaped as a regular polygon, with arms 101 which extend outwardly from the polygonal edges 100A of enhancer 100. Arms 101 may be attached to edges 100A directly, or indirectly through struts 121. Alternatively, arms 101 may be attached to vertices 100B of the regular polygon, or to a combination of edges 100A and vertices 100B. The hole 104 in the polygonal safety cone enhancer 100 may have an axis which is equidistant from all corners of the regular polygon. The polygonal safety cone enhancer 100 may be shaped as a triangle, square, pentagon, hexagon, etc. The circular hole 104 may extend through the geometric center of the safety cone enhancer 100 from a top surface to a bottom surface, and may have a diameter large enough to fit on top of a triangular safety cone and to rest on the top portion of the safety cone, without falling to the base of the safety cone. The circular hole 104 in the safety cone enhancer 100 may have a diameter D3 which is less than the first diameter D1 of the base of the conical member of the safety cone; and greater than the second diameter D2 of the apex of the conical member of the safety cone, i.e., D1>D3>D2.

The polygonal safety cone enhancer 100 may be shaped as a triangle, square, pentagon, hexagon, etc. In cases where the safety cone enhancer is shaped as a regular polygon with an even number of sides, arms 101 may extend outwardly from each polygonal edge 100A, or from alternating polygonal edges 100A. In cases where the safety cone enhancer is shaped as a regular polygon with an odd number of sides, arms 101 may extend outwardly from each polygonal edge 100A.

The safety cone enhancer 100 of FIG. 1A or 1B has a plurality of LED holes 103, configured to receive electrically powered LEDs, where LED holes 103 may be positioned on the top surface 106 of safety cone enhancer 100, on a peripheral edge surface 109 of safety cone enhancer 100, or on both the top surface 106 and edge surface 109. LED holes 103 may be positioned on edge surface 109, and extend into the edge surface 109, perpendicular to an axis of hole 104 of safety cone enhancer 100. The LEDs may be inserted into or through holes 103 on the top surface 106 of safety cone enhancer 100, or may be positioned beneath holes 103. The LED holes 103*a* are configured to receive electrically powered LEDs as an additional safety feature for the safety cone enhancer 100.

Figure 2A:
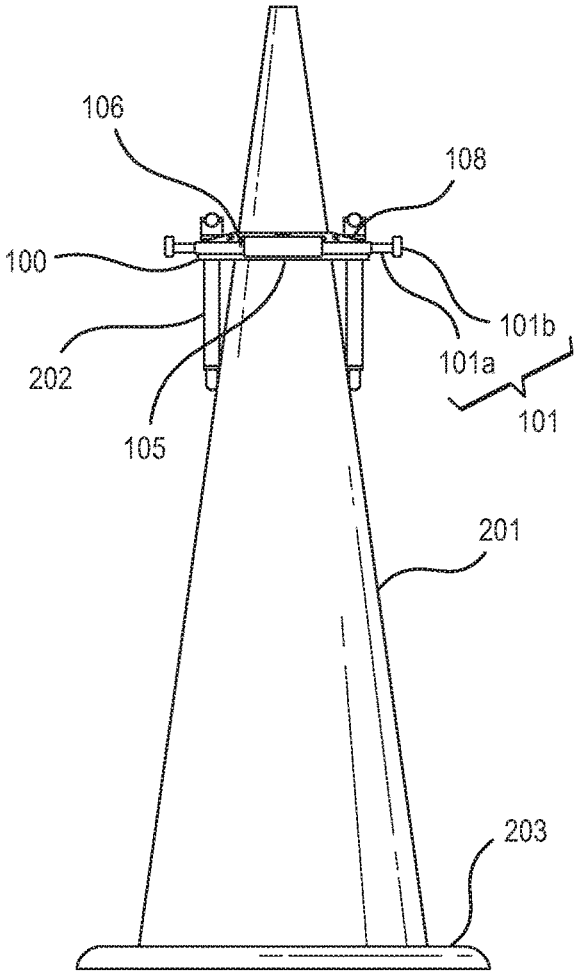
FIG. 2A illustrates a perspective view of a safety cone enhancer of FIG. 1A, positioned on a safety cone with glow sticks positioned in the safety cone enhancer.
Figure 2B:
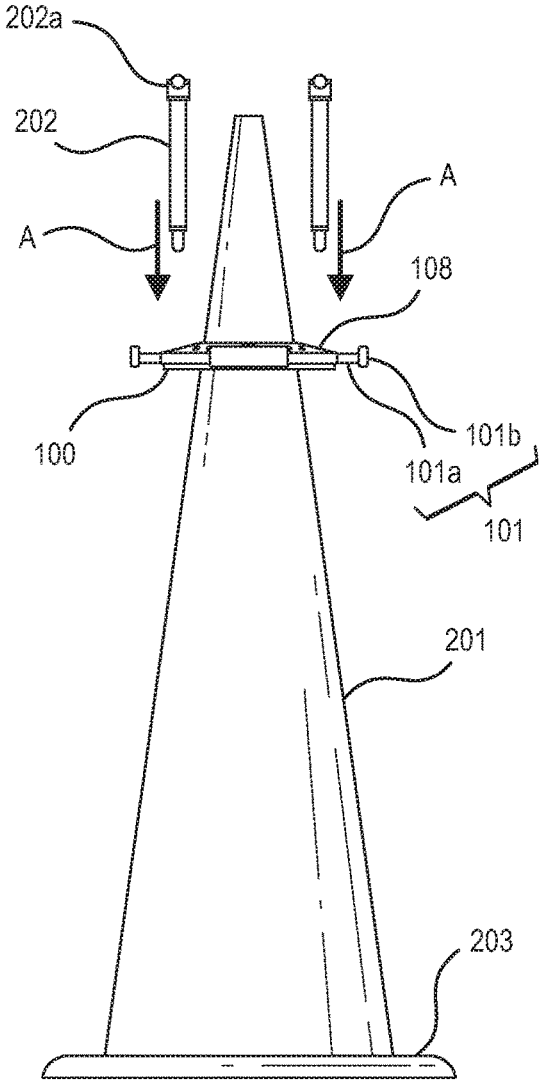
FIG. 2B illustrates a perspective view of a safety cone enhancer of FIG. 1A, positioned on a safety cone with glow sticks being inserted into the safety cone enhancer.

FIG. 2A illustrates a view of a safety cone enhancer 100 in the present embodiment, positioned on a safety cone 201 with glow sticks 202, flares, or similar devices being inserted into the safety cone enhancer through glow stick holes 108. The bottom surface of the safety cone enhancer 100 is positioned on the safety cone 201 and rests on the top portion of the safety cone 201, without falling to the base 203 of the safety cone 201. Glow stick holes 108 may extend from the top surface 106 of safety cone enhancer 100 to bottom surface 105 of safety cone enhancer 100. Holes 108 may be used to insert glow sticks or other chemically powered lighting devices 202 into safety cone enhancer 100, as seen in FIG. 2A and FIG. 2B. The glow sticks or other chemically-powered lighting devices 202 may have a top end 202*a* with a wider circumference than the remainder of the lighting devices 202, to allow the top end 202*a* of lighting device 202 to rest on the top surface 106 of the safety cone enhancer 100, preventing the lighting device 202 from falling through holes 108, as seen in FIG. 2A. FIG. 2B shows glow sticks 202 being inserted into holes 108 in safety cone enhancer 100, in the direction of arrows A. The glow sticks 202 may each be the same color, or the glow sticks may be different colors.

The LED holes 103 may be positioned in the top surface 106 of the safety cone enhancer 100, or in a peripheral edge of enhancer 100, as seen in FIG. 1A. The LED holes 103 may be equally spaced around the safety cone enhancer 502. The LED holes 103 in the safety cone enhancer 100 are configured for use with electrically powered light emitting devices, such as light emitting diodes. The safety cone enhancer 100 may include a battery-powered or solar-powered circuit to transmit power to electrically powered light emitting devices positioned in holes 103. A switch in the safety cone enhancer 100 may be used to turn the circuit on or off, as desired. When an electrically powered LED is inserted into a hole 103, it makes electrical contact with the circuit in safety cone 100, allowing the LED to be turned on or off with the switch.

Holes 108 in the safety cone enhancer 100 may be configured for use with devices which emit light due to a chemical reaction, such as glow sticks. Each LED hole 103 may be electrically powered for use with light emitting diodes, and each hole 108 may be non-powered for use with glow sticks. The safety cone enhancer 100 may include a combination of electrically powered holes 103 and non-powered holes 108.

The LED holes 103 may positioned in the top surface 106 of the safety cone enhancer 100, or on a peripheral edge of the safety cone enhancer 100, as shown in FIGS. 1A and 1B. The LED holes 108 may positioned in the top surface 106 of the safety cone enhancer 100, and extend from a top surface to a bottom surface of the safety cone enhancer 100. The LED holes 103 and glow stick holes 108 may be equally spaced around the safety cone enhancer 100.

Each LED present in a hole 103 in safety cone enhancer 100, as shown in FIG. 1A, may emit light in a selected color, which may be white, red, green, yellow, amber or any other desired color. Multiple LEDs may be inserted into holes 103 in in safety cone enhancer 100, with each LED occupying a different hole 103. Where multiple LEDs are used, all LEDs may be the same color or multiple different colors of LEDs may be used. Each LED may be configured to blink, to shine with a variable intensity, or to shine steadily at a constant intensity. The LEDs may shine and be visible from the top surface 106, from edge surface 109, or both top surface 106 and edge surface 109. The LEDs may extend out of hole 103 to allow them to shine in various directions.

FIG. 3A illustrates a perspective view of the safety cone enhancer 100 of FIG. 1A on a safety cone 201, with flag poles 302 of safety flags 301 positioned in into holes 102 in the safety cone enhancer 100. The bottom surface of the safety cone enhancer 100 is positioned on the safety cone 201 and rests on the top portion of the safety cone 201, without falling to the base 203 of the safety cone 302. Two safety flags 301 are supported on flagpoles 302. Each flagpole 302 is inserted through a flag hole 102 in safety cone enhancer 100. FIG. 3B shows a view of a safety cone 201 supporting safety cone enhancer 100. Two flagpoles 302 are being inserted into a flag hole 102 in safety cone enhancer 100, in the direction of arrows B.

The flag holes 102 extending through the safety cone enhancer 100 may be parallel to an axis of hole 104 in enhancer 100, as shown in FIG. 1A. If the flag holes 102 and axis of hole 104 are parallel, this allows the pole of safety flag 301 to stand upright upon insertion into hole 102, as shown in FIG. 3A. Alternatively, the flag holes 102 may be angled relative to the axis of hole 104, so as to allow the safety flags 301 to be angled away from the safety cone 201 and to increase the visibility of safety cone 201, as shown in FIG. 3C. An axis of a flag hole 102 and the axis of hole 104 may form an angle of between 10° and 60°, between 20° and 40°, between 25° and 35°, or about 30°.

After insertion of safety flags 301 into flag holes 102, the position of the safety flags may be adjusted to optimize visibility by rotating safety cone enhancer 100 around the conical surface of the safety cone 201. The safety flags 301 may have a variety of colors, shapes, and designs, or may carry printed warning messages. Multiple flags may be inserted into the plurality of flag holes 102, with one flag occupying a single flag hole.

Figure 1C:
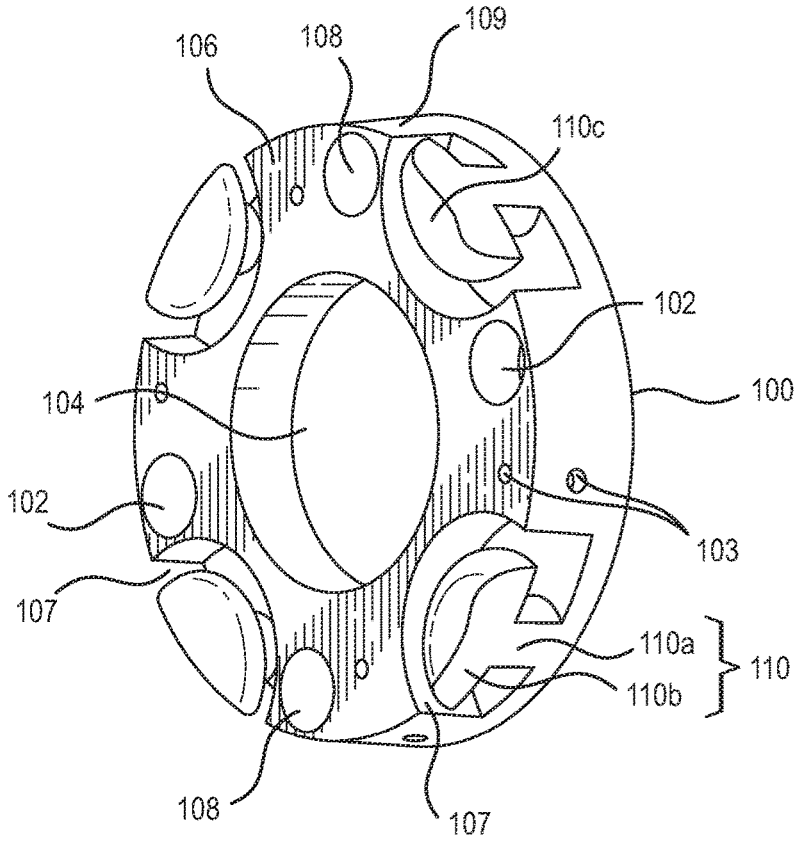
FIG. 1C illustrates a perspective view of the safety cone enhancer in a third embodiment.

FIG. 1C illustrates a perspective view of the safety cone enhancer 100 in an alternative embodiment. The safety cone enhancer 100 may be circular in shape with a circular hole 104 in the center of the safety cone enhancer 100. The circular hole 104 may extend through the center of the safety cone enhancer 100 and may have a diameter large enough to fit on top of a triangular safety cone and to rest on the top portion of a safety cone, without falling to the base of the safety cone. When positioned on the safety cone, the safety cone enhancer 100 may rotate around the vertical axis of the safety cone to change the position of the safety cone enhancer 100.

The safety cone enhancer 100 of FIG. 1C may include a plurality of cleats 110 around the outer edge of the safety cone enhancer 100. The cleats 110 are positioned in semicircular grooves 107 around the outer surface of the top surface 106 of the safety cone enhancer 100.

The cleats 110 extend upwards in a vertical direction, and have an upper surface 110*c* which is flush with top surface 106 of safety cone enhancer 100. The cleats 110 may be equally spaced apart from each other, around the periphery of safety cone enhancer 100. The cleats 110 may have a support 110*a* connected to the safety cone enhancer 100, and a head 110*b* connected to the support 110. The support 110*a* and head 110*b* of each cleat 110 may be have a cross section which is semicircular in shape. The head 110*b* may have opposite sides, each with a different radius of curvature. One side of head 110*b* may have a radius of curvature which conforms to the outer radius of the safety cone enhancer 100, as shown in FIG. 1C. The other side of head 110*b* may have a radius of curvature which conforms to the curvature of the semicircular groove 107.

The embodiment of FIG. 1C includes LED holes 103 and/or glow stick holes 108, if desired, which may be similar to those described above with respect to FIGS. 1A and 1B.

Figure 1D:
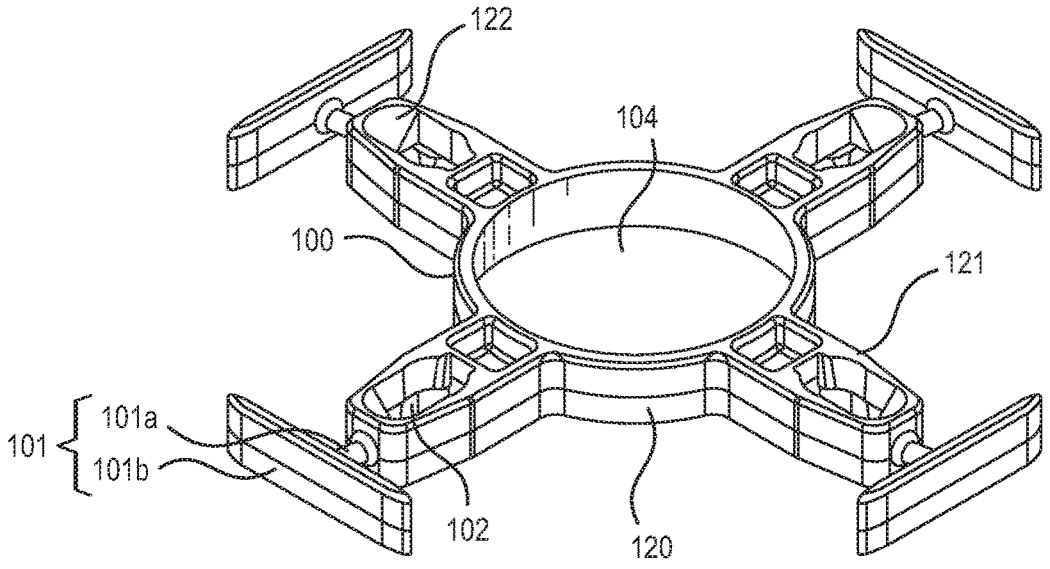
FIG. 1D illustrates a perspective view of the safety cone enhancer in a fourth embodiment.

FIG. 1D shows a fourth embodiment of the safety cone enhancer 100. The safety cone enhancer 100 of FIG. 1D includes a ring 120 and a plurality of evenly spaced struts 121 extending from ring 120. A hole 104 in the center of ring 120 fits over the top of a traffic cone. Each strut 121 has a hole 102 for receiving a flagpole supporting a safety flag. In the embodiment of FIG. 1D, each hole 102 is elongated, with a sloped surface 122 at the outer end of strut 121. The flagpole may be positioned in hole 102 so that a lower end of the flagpole contacts the side of the traffic cone, and a side of the flagpole rests against surface 122. This causes the flagpole to be held at an angle, increasing flag visibility. One or more struts 121 may include glow stick holes 108, if desired (not shown).

The safety cone enhancer of FIG. 1D includes an arm 101 at the end of each strut 121. Each arm 101 has a connector 101*a* that extends from the end of strut 121, and a head 101*b* connected to the connector 101*a*. The head may be wider than the connector in in at least one dimension, in order to facilitate securing safety tape between adjacent cones. As seen in FIG. 1D, the head 101*b* of arm 101 may be elongated, and longer than connector 101*a* in at least one dimension.

Figure 4A:
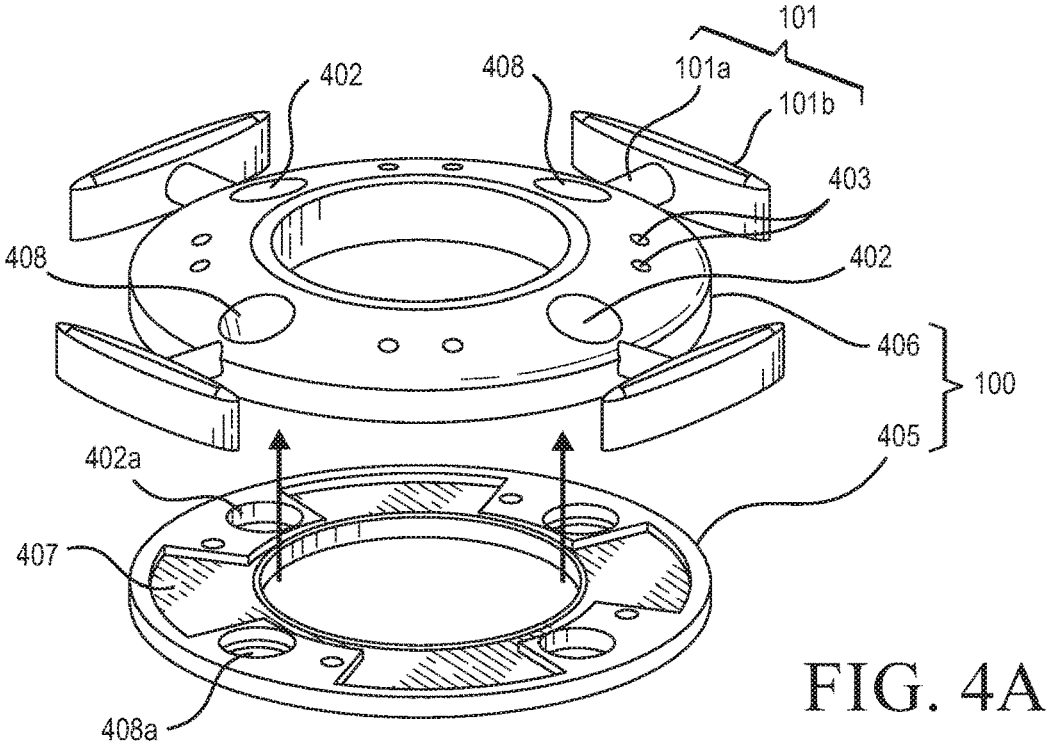
FIG. 4A illustrates an exploded view of the safety cone enhancer of FIG. 1A, illustrating assembly from a top piece 206 and a bottom piece 207.

FIG. 4A illustrates a perspective view of the two pieces of the safety cone enhancer in the present embodiment. The safety cone enhancer 100 is composed of two pieces, a top piece 406 and a bottom piece 405, which connect together to form the safety cone enhancer 100. The top piece 406 of the safety cone enhancer 100 may include a plurality of LED openings 403, which are configured to include electrically powered LEDs. The LED holes 403 may be in the top surface or peripheral edge of top piece 406 of safety cone enhancer 100. The top piece 206 of the safety cone enhancer 100 may include a plurality of holes 408, which are configured to receive chemically powered light emitting devices, such as glow sticks or flares. The top piece 406 of the safety cone enhancer 100 may include a plurality of holes 402, configured to receive the poles of signal flags. The glow stick/flare holes 408 and flag holes 402 are in the top surface of top piece 206 of safety cone enhancer 100. Top piece 406 may include arms 101, as shown in FIG. 4A.

The bottom portion 405 of the safety cone enhancer 100 includes holes 402*a* and 408*a*, which correspond in size and shape to glow stick/flare holes 408 and flag holes 402 in top piece 406. The bottom portion 405 of the safety cone enhancer 100 does not generally include holes which correspond to electrically-powered LED holes 403. The bottom portion 405 may include rectangular or arc-shaped grooves 407 which may include circuitry, batteries, solar cells, or other apparatus for transmitting power to electrically powered LEDS visible through LED holes 403. The LEDs in LED holes 203*a* may be replaced by separating parts 405 and 406 to access the rectangular groove 407, or by inserting LEDs through openings 403 to contact circuitry in grooves 407.

When pieces 406 and 405 are assembled to form safety cone enhancer 100, holes 408 and 408*a* in pieces 406 and 405 line up to form glow stick holes 108. Holes 402 and 402*a* in pieces 406 and 405 line up to form glow flag holes 402. Holes 403 in piece 406 are positioned over an LED connected to electronic circuitry or batteries in groove 407 of bottom portion 405. A switch in the bottom portion (not shown) may be used to turn power to the LED on and off, as desired. Holes 403 in piece 406 may be open, or covered with clear plastic to protect the LED without impeding light visibility. The LEDs may be held on printed circuit boards, located on the inside of the plastic housing of safety cone enhancer 100, or formed upon joining parts 405 and 406. The printed circuit boards may be located in groove 407 of bottom plate 405, with the LEDs being connected to the printed circuit boards, so as to shine upwards. In some embodiments, part 406 is made from clear plastic, so that lights from the LEDs shine visibly through part 406 while allowing the electronics and circuit boards within safety cone enhancer 100 to be shielded from the elements. In other embodiments, part 406 is made from opaque plastic with holes 403 therethrough, so that lights from the LEDs shine visibly through holes 403 in part 406. Also, part 406 may be made from opaque plastic with transparent plastic coverings or windows over holes 403, so that lights from the LEDs shines visibly through holes 403 while allowing the electronics and circuit boards within safety cone enhancer 100 to be shielded from the elements by the transparent plastic coverings or windows.

Figure 4C:
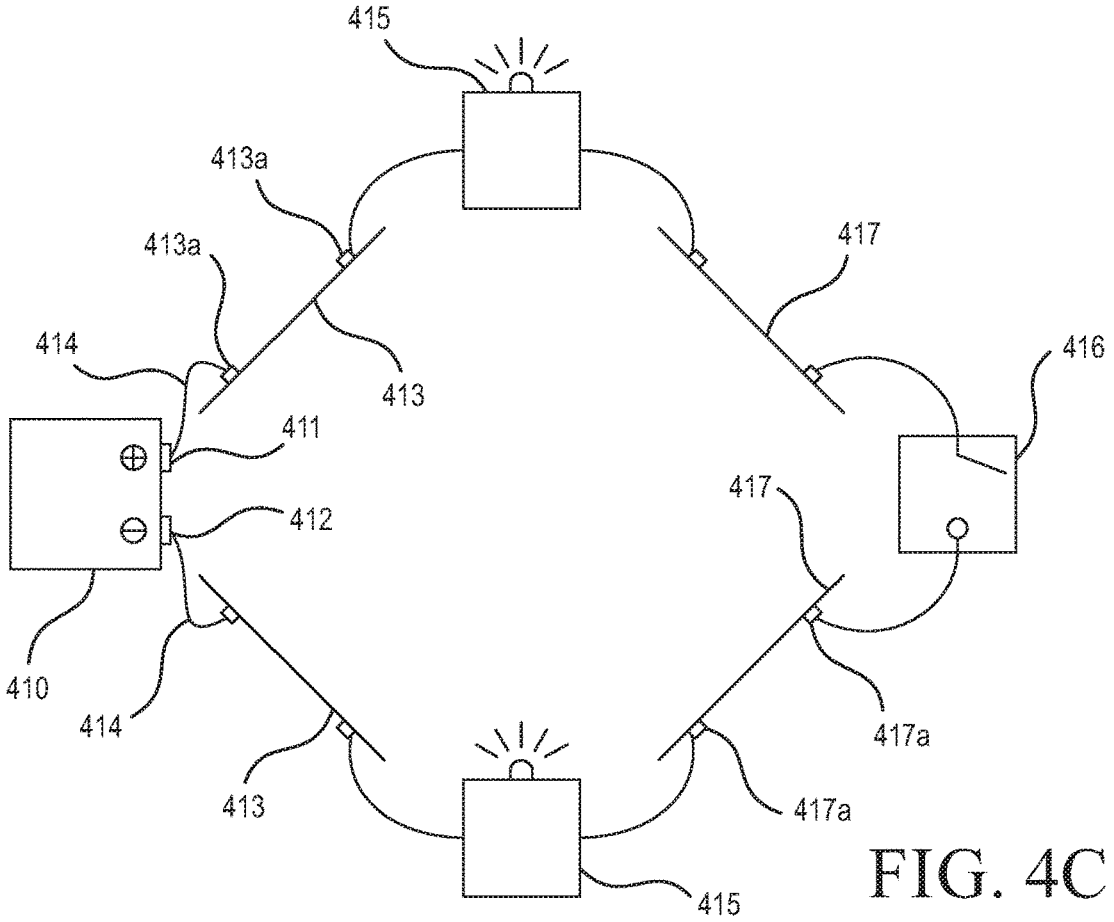
FIG. 4C illustrates the circuitry in the safety cone enhancer of FIG. 4B.
Figure 4B:
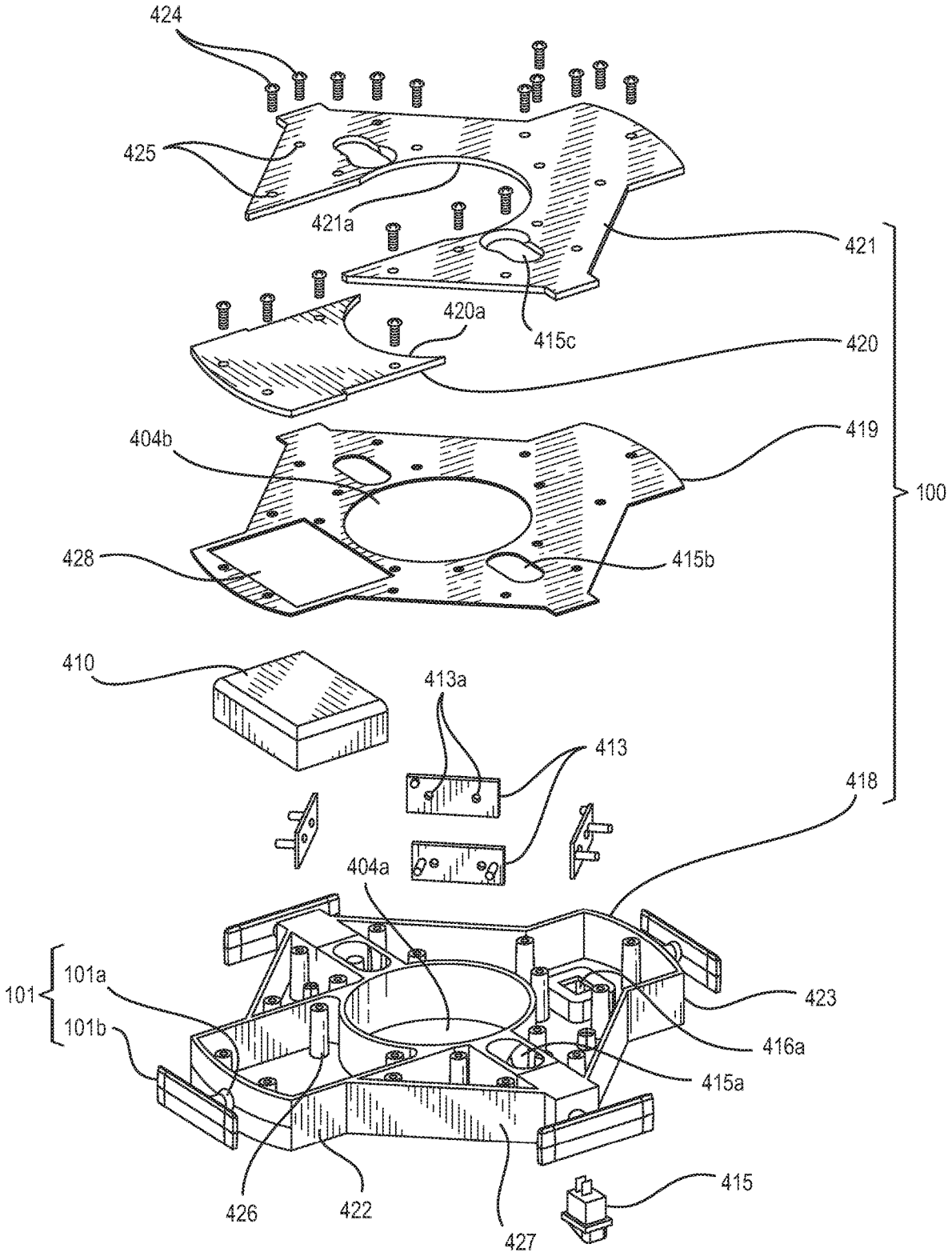
FIG. 4B illustrates an exploded view of a safety cone enhancer configured to contain LED lights and electrical circuitry therefore.

FIG. 4B provides an exploded view of an alternative embodiment of a safety cone enhancer 100 as disclosed herein. The housing of enhancer 100 is assembled from base 418, cover 419, lid 421, and battery cover 420. The base 418 includes a central hole 404*a*, a hollow arm 422 configured to hold a battery 410, and a hollow arm 423 with an opening 416*a* configured to receive a switch 416 (shown in FIG. 4C). Openings 415*a* are configured to receive LEDs 415. Base 418 has four arms 101, generally as described in FIG. 1A. Base 418 has four walls 427. Each wall supports a circuit board 413, where each circuit board has two electrical contacts 413*a* For the purposes of FIG. 4B, all circuit boards 413 are treated as identical. In FIG. 4C, circuit boards 413 will be distinguished based on their position in a circuit.

Cover 419 is positioned over base 418. Cover 419 is positioned so that hole 404*b* aligns with hole 404*a*, forming an opening generally similar to hole 104 as described in FIG. 1A. Openings 415*b* align with openings 415*a* of base 418, and allow LEDs 415 to shine therethrough. Opening 428 is positioned over battery 410, so that battery 410 may be replaced as needed.

Battery cover 420 is fastened over opening 428, and protects battery 410 from exposure to the elements. Lid 421 fits over cover 419. Lid 421 has a curved edge 421*a* which aligns with a first portion of hole 404*b* in cover 419. Battery cover 420 has a curved edge 420*a* which aligns with a second portion of hole 404*b* in cover 419. When assembled, edges 420*a* and 421*a* align with hole 404*a* and 404*b*. Screws 424 may be passed through holes 425 in elements 419, 420, and 420, and screwed into bores of screw receiving posts 426 in base 418. The safety cone enhancer 100 is thus assembled by securing base 418, cover 419, lid 420, and battery cover 421 together.

By making lid 421 out of transparent plastic, holes 415*c* may be omitted, and LEDs 415 will be protected from the elements. Alternatively, by making cover 419 out of transparent plastic, holes 415*b* may be omitted while protecting LEDs 415 from the elements. If both lid 421 and cover 419 are made from transparent plastic, holes 415*b* and 415*c* are not required, simplifying construction of the safety cone enhancer of FIG. 4B.

FIG. 4C provides a view of the circuitry in the embodiment of FIG. 4B. The circuit includes battery 410, two LEDs 415, and a switch 416. As shown in FIG. 4C, battery 410 has a positive terminal 411 and a negative terminal 412. Each terminal 411 and 412 is electrically connected via a wire or other electrical connector 414 to a contact 413*a* on a circuit board 413. Another contact 413*a* on each circuit board 413 is electrically connected via a second wire or other electrical connector 414 to an LED 415. Thus, the battery 410 is electrically connected to two LEDs 415 via an intervening circuit board, as shown in FIG. 4C.

Each LED is connected to a contact 417*a* on one of two circuit boards 417 via a wire or other electrical connector 414. A second contact 417*a* on each circuit board 417 is connected to switch 416. When switch 416 is open, electrical power cannot pass through the circuit, and LEDs 415 will not light. When switch 416 is closed, electrical power passes through the circuit and the LEDs, and LEDs 415 emit light.

Figure 5A:
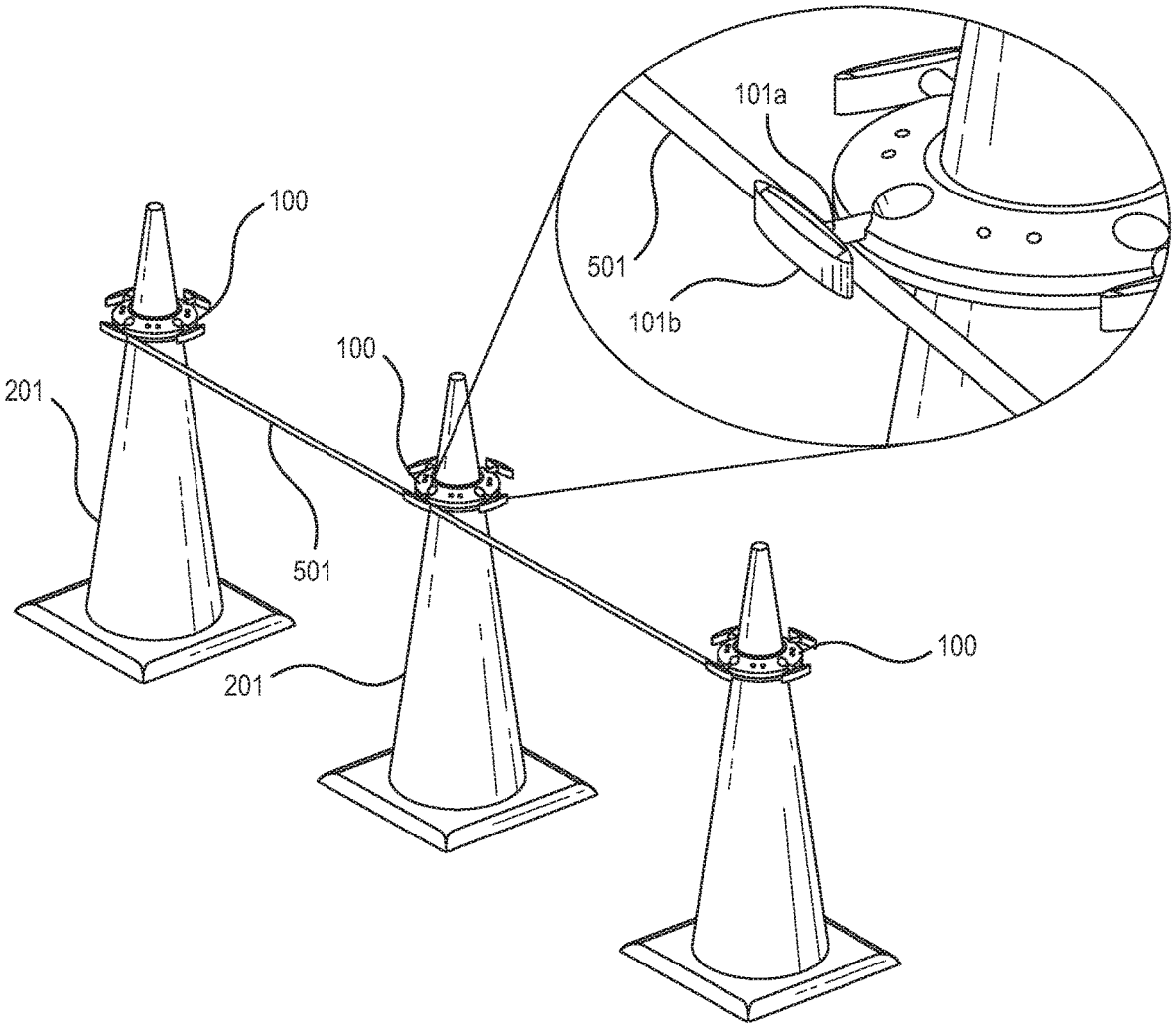
FIG. 5A illustrates a perspective view of a plurality of safety cone enhancers of FIG. 1A, positioned on a plurality of safety cones attached together by safety tape.

FIG. 5A illustrates a perspective view of three safety cone enhancers 100 positioned on three safety cones 201 attached together by safety tape 501. FIG. 5A also includes a zoomed in view of the operation of the arms 101 with respect to the safety tape 501. As seen in the inset view of FIG. 5A, the safety cone enhancer 100 includes a plurality of arms 101 which are configured to hold the safety tape 501 as the safety tape 501 connects to each of the safety cones 402. The safety tape 501 fits above or below the arms 101 and is held by the arm 101. The safety tape 501 may also be wrapped around the connector 101*a* of arm 101, with head 101*b* preventing safety tape 501 from slipping of arm 101. The arms 101 also prevent the need to tie the tape 501 in a knot around the top of non-terminal safety cones 201, although tape 501 may be tied to an arm 101 of an initial safety cone enhancer or a final safety cone enhancer, where multiple safety cones are used in series. The safety cones 201 may be positioned at varying distances from each other.

Figure 5B:
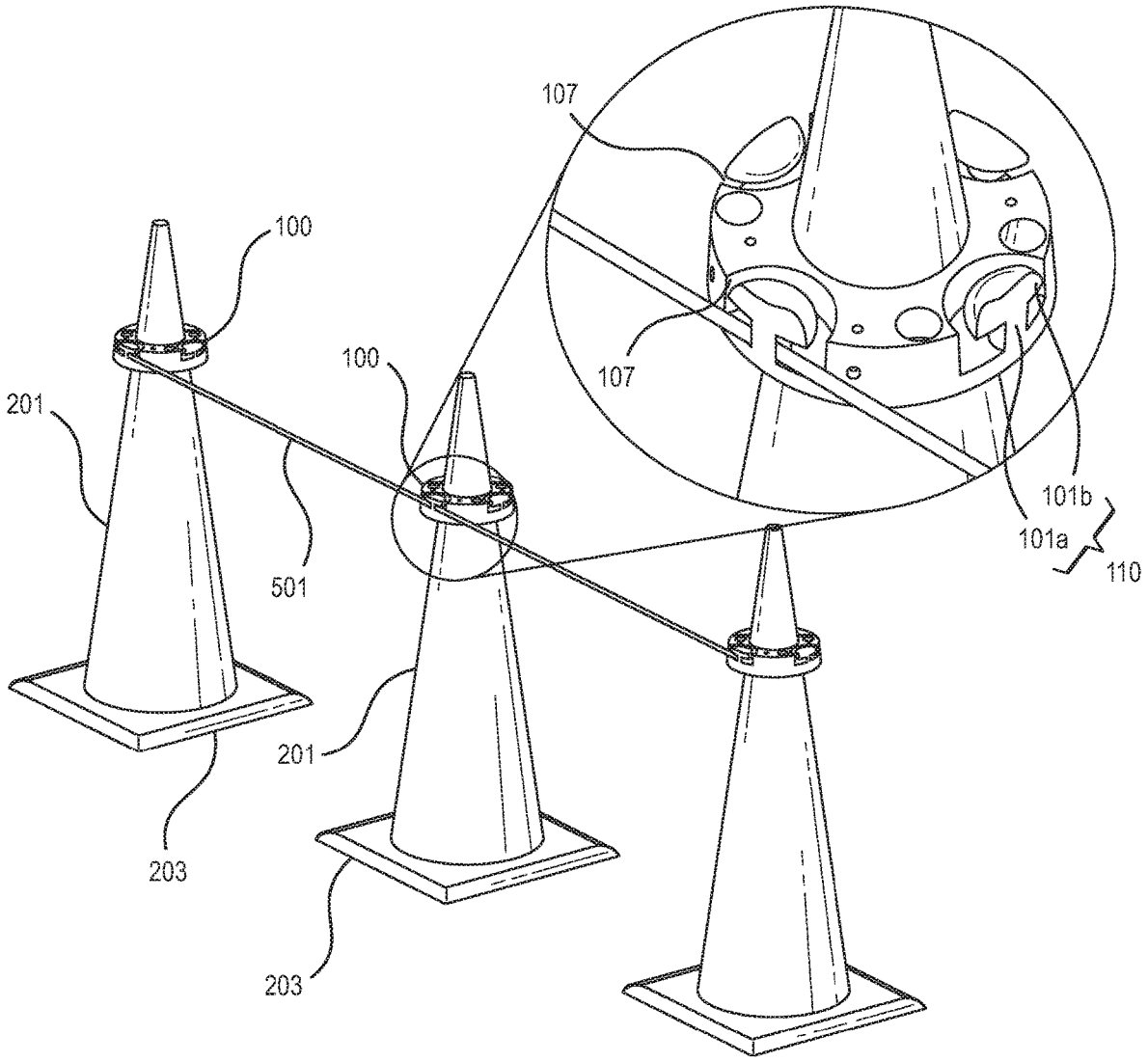
FIG. 5B illustrates a perspective view of a plurality of safety cone enhancers of FIG. 1C, positioned on a plurality of safety cones attached together by safety tape.

FIG. 5B illustrates a perspective view of three safety cone enhancers 100 with cleats 110 as in FIG. 1C, where enhancers 100 are positioned on three safety cones 201 attached together by safety tape 501. FIG. 5B also includes an inset view showing the operation of the cleats 110 with respect to the safety tape 501. The safety cone enhancer 100 includes a plurality of cleats 110 which are configured to hold the safety tape 501 as the safety tape 501 connects to each of the safety cones 201. The safety tape 501 fits within a semicircular groove 107 and is held by a cleat 110. The semicircular groove allows the safety tape 501 to be fitted within groove 107, adjacent to the cleat 110. The cleat 110 then holds the safety tape 501, which prevents it from falling down to the base 203 of the safety cone 201. The cleat 110 also prevents the need to tie the tape in a knot around the top of the safety cone 201. The cleat 110 also avoids the need to tie the tape 501 in a knot around the top of non-terminal safety cones 201, although tape 501 may be tied to a cleat 110 of an initial safety cone enhancer or a final safety cone enhancer, where multiple safety cones are used in series. The safety cones 201 may be positioned at varying distances from each other. If desired, tape 501 may be wrapped around support 110*a*. Head 110*b* of cleat 110 holds tape 501 in position next to support 110*a*.

Although the various embodiments have been described in detail with particular reference to certain aspects thereof, it should be understood that the invention is capable of other embodiments and its details are capable of modifications in various obvious respects. As is readily apparent to those skilled in the art, variations and modifications can be effected while remaining within the spirit and scope of the invention. Accordingly, the foregoing disclosure, description, and figures are for illustrative purposes only and do not in any way limit the invention, which is defined only by the claims.

What is claimed is:

1. An apparatus for use with a traffic cone having a conical member with a first diameter at a base of the conical member and a second diameter at a top of the conical member, said apparatus comprising:

a ring-shaped member with a top surface, a bottom surface, an outer diameter and an inner diameter, said inner diameter being less than the first diameter and greater than the second diameter;

a plurality of arms, each arm having a connector connected with the ring-shaped member and a head which is wider than the connector in at least one dimension, the head having an inner surface connected to the connector and an outer surface; and at least one of:

a first hole in said ring-shaped member extending through said ring-shaped member from the top surface to the bottom surface, said first hole being configured to receive a first signaling device; and a second signaling device which shines light from the top surface or radially from an outer edge of the ring-shaped member;

wherein the outer surface of the head is planar or convex.

2. An apparatus for use with a traffic cone having a conical member with a first diameter at a base of the conical member and a second diameter at a top of the conical member, said apparatus comprising:

a ring-shaped member with a top surface, a bottom surface, an outer diameter and an inner diameter, said inner diameter being less than the first diameter and greater than the second diameter;

a plurality of T-shaped arms, each T-shaped arm having a connector connected with the ring-shaped member and an elongated head which is wider than the connector in at least one dimension; and at least one of:

a first hole in said ring-shaped member extending through said ring-shaped member from the top surface to the bottom surface, said first hole being configured to receive a first signaling device; and a second signaling device which shines light from the top surface or radially from an outer edge of the ring-shaped member.

3. The apparatus of claim 2, wherein the connector in each T-shaped arm extends radially from the ring-shaped member, and the elongated head in each T-shaped arm is wider than the connector in a direction which is parallel to a cylindrical axis of said ring-shaped member.

4. The apparatus of claim 1, wherein the connector in each arm has a first width and extends radially from the ring-shaped member, and the head in each arm has a second width which is greater than the first width.

5. The apparatus of claim 1, wherein the connector in each arm extends vertically from the ring-shaped member, and the head in each arm is positioned in a groove in a top surface of said ring-shaped member.

6. The apparatus of claim 1, wherein the apparatus comprises the first hole in said ring-shaped member, said first hole being configured to receive the first signaling device, said first signaling device being a safety flag.

7. The apparatus of claim 1, wherein said first hole is configured to receive the first signaling device, said first signaling device being a glow stick or flare.

8. The apparatus of claim 1, wherein the ring-shaped member has a planar top surface.

9. The apparatus of claim 1, wherein the ring-shaped member has a beveled top surface.

10. A kit, comprising:

at least one apparatus for use with a traffic cone as claimed in claim 1;

at least one first signaling device, wherein each first signaling device is configured to be positioned in the first hole of the apparatus of claim 1; and safety tape, wherein at least one of the arms connected with the ring-shaped member is configured to be connected with the safety tape.

11. The apparatus of claim 1, wherein the apparatus comprises the second signaling device, said second signaling device being an LED signal light.

12. The apparatus of claim 11, wherein the apparatus comprises the first hole in said ring-shaped member, said first hole being configured to receive a safety flag.

13. An apparatus for use with a traffic cone having a conical member with a first diameter at a base of the conical member and a second diameter at a top of the conical member, said apparatus comprising:

a polygonal member with a top surface, a bottom surface, a plurality of edges; and a hole with a third diameter therethrough, said third diameter being less than the first diameter and greater than the second diameter;

a plurality of arms, each arm having a connector extending from the polygonal member and a head which is wider than the connector in at least one direction, the head having an inner surface connected to the connector and an outer surface; and at least one of:

a first hole in said polygonal member extending through said polygonal member from the top surface to the bottom surface, said first hole being configured to receive a first signaling device; and a second signaling device which shines light from the top surface of the polygonal member;

wherein the outer surface of the head is planar or convex.

14. The apparatus of claim 13, wherein the connector in each arm extends from one of said edges of said polygonal member.

15. The apparatus of claim 13, wherein the connector in each arm extends from a vertex of said polygonal member.

16. The apparatus of claim 2, wherein the connector in each T-shaped arm extends radially from the ring-shaped member, and the elongated head in each T-shaped arm is wider than the connector in a direction which is perpendicular to a cylindrical axis of said ring-shaped member.

* * * * *